US005750476A

United States Patent [19]

Nibert et al.

[11] Patent Number: 5,750,476

[45] Date of Patent: May 12, 1998

[54] POWER TRANSMITTING FLUIDS WITH IMPROVED ANTI-SHUDDER DURABILITY

[75] Inventors: Roger Keith Nibert, Hampton; Ricardo Alfredo Bloch, Scotch Plains; Maryann Devine, Lincroft; Manoj Tandon, Princeton; Raymond Frederick Watts, Long Valley, all of N.J.

[73] Assignee: Exxon Chemical Patents Inc., Wilmington, Del.

[21] Appl. No.: 544,955

[22] Filed: Oct. 18, 1995

[51] Int. Cl.[6] ..... C10M 133/16

[52] U.S. Cl. ..... 508/291

[58] Field of Search ..... 252/51.5 R, 51.5 A, 252/32.5, 49.8; 508/291, 293; C10M 137/000, 133/16

[56] References Cited

U.S. PATENT DOCUMENTS

| | | | |
|---|---|---|---|
| 3,216,936 | 11/1965 | LeSuer . | |
| 3,382,172 | 5/1968 | Lowe . | |
| 3,544,467 | 12/1970 | Knutsky . | |
| 3,955,940 | 5/1976 | Hollyday . | |
| 4,613,341 | 9/1986 | Zaweski et al. . | |
| 4,659,492 | 4/1987 | Jahnke . | |
| 4,780,111 | 10/1988 | Dorer et al. . | |
| 4,997,594 | 3/1991 | Walsh . | |
| 5,122,616 | 6/1992 | Malfer | 548/546 |
| 5,156,654 | 10/1992 | Koch et al. | 44/331 |
| 5,176,840 | 1/1993 | Campbell et al. . | |
| 5,225,093 | 7/1993 | Campbell et al. . | |

FOREIGN PATENT DOCUMENTS

| | | | |
|---|---|---|---|
| 0020037-A1 | 12/1980 | European Pat. Off. | C10M 1/36 |
| 0448207 | 9/1991 | European Pat. Off. . | |

*Primary Examiner*—Prince Willis, Jr.
*Assistant Examiner*—Cephia D. Toomer
*Attorney, Agent, or Firm*—John W. Ditsler

[57] ABSTRACT

The anti-shudder durability of power transmitting fluids, particularly automatic transmission fluids, is improved by incorporating a combination of low potency friction modifiers and phosphorus-containing compounds. The anti-shudder durability of these fluids may be further enhanced by inclusion of a metallic detergent and/or a polyol ester friction modifier.

13 Claims, No Drawings

POWER TRANSMITTING FLUIDS WITH IMPROVED ANTI-SHUDDER DURABILITY

This invention relates to a composition and a method of improving the anti-shudder durability of power transmitting fluids, particularly automatic transmission fluids.

The continuing search for methods to improve overall vehicle fuel economy has identified the torque converter, or fluid coupling, used between the engine and automatic transmission, as a relatively large source of energy loss. Since the torque converter is a fluid coupling it is not as efficient as a solid disk type clutch. At any set of operating conditions (engine speed, throttle position, ground speed, transmission gear ratio), there is a relative speed difference between the driving and driven members of the torque converter. This relative speed differential represents lost energy which is dissipated from the torque converter as heat.

One method of improving overall vehicle fuel economy used by transmission builders is to build into the torque converter a clutch mechanism capable of "locking" the torque converter. "Locking" refers to eliminating relative motion between the driving and driven members of the torque converter so that no energy is lost in the fluid coupling. These "locking" or "lock-up" clutches are very effective at capturing lost energy at high road speeds. However, when they are used at low speeds vehicle operation is rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally a relative speed of 50 to 500 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

Continuously slipping torque converter clutches impose very exacting friction requirements on automatic transmission fluids (ATF's) used with them. The fluid must have a very good friction versus velocity relationship, i.e., friction must always increase with increasing speed. If friction decreases with increasing speed then a self-exciting vibrational state can be set up in the driveline. This phenomenon is commonly called "stick-slip" or "dynamic frictional vibration" and manifests itself as "shudder" or low speed vibration in the vehicle. Clutch shudder is very objectionable to the driver. A fluid which allows the vehicle to operate without vibration or shudder is said to have good "anti-shudder" characteristics. Not only must the fluid have an excellent friction versus velocity relationship when it is new, it must retain those frictional characteristics over the lifetime of the fluid, which can be the lifetime of the transmission. The longevity of the anti-shudder performance in the vehicle is commonly referred to as "anti-shudder durability". It is this aspect of performance that this invention addresses.

We have found that certain compounds made by reacting isomerized alkenyl substituted succinic anhydrides (and their saturated alkyl analogs) with polyamines, when used with oil-soluble phosphorus compounds, and optionally, overbased metallic detergents and/or polyol ester friction modifiers, provide a unique solution to the problem of extending anti-shudder durability.

SUMMARY OF THE INVENTION

This invention relates to a composition and method of improving the anti-shudder durability of a power transmitting fluid comprising:

(1) a major amount of a lubricating oil; and (2) an anti-shudder improving effective amount of an additive combination comprising:

(a) a reaction product of an isomerized alkenyl substituted succinic anhydride and a polyamine characterized by structure (I), where structure (I) is:

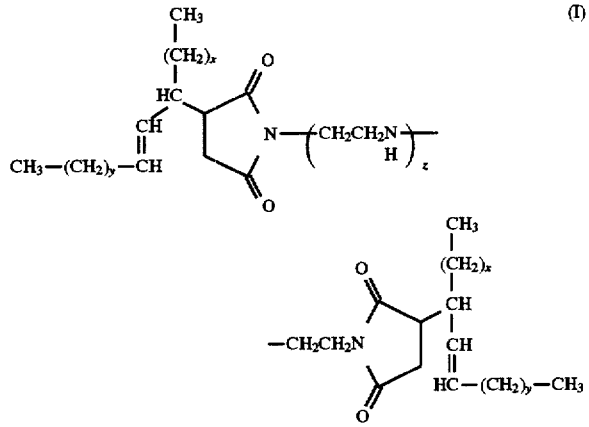

(I)

where x and y are independent integers whose sum is from 1 to 30, and z is an integer from 1 to 10;

(b) an oil-soluble phosphorus-containing compound; and (c) optionally, an additive selected from the group consisting of a metallic detergent, a polyol ester friction modifier, and mixtures thereof.

Another embodiment of this invention is when structure (I) contains the saturated alkyl analogs of the isomerized alkenyl substituted groups.

DETAILED DESCRIPTION OF THE INVENTION

We have found that fluids containing combinations of the compound of structure (I) and oil-soluble phosphorus compounds not only provide excellent fresh oil friction versus velocity characteristics, but that these characteristics, are retained for as much as 10 times as long as those found in conventional automatic transmission fluids. The anti-shudder durability of these fluids can be further improved by optionally incorporating overbased metallic detergents and/or polyol ester friction modifiers.

While the invention is demonstrated for a particular power transmitting fluid, i.e., an ATF, it is contemplated that the benefits of this invention are equally applicable to other power transmitting fluids. Examples of other types of power transmitting fluids included within the scope of this invention are gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and in a variety of base oils.

Increasing the anti-shudder durability of an ATF is a very complex problem. Although it appears that a simple solution would be to merely increase the amount of conventional friction modifier in the fluid, this is not feasible because simply increasing the concentration of conventional friction modifiers, significantly reduces the overall level of friction exhibited by the fluid. Reduction of friction coefficients below certain minimum levels is undesirable since the holding capacity, or static capacity, of all the clutches in the transmission is thereby reduced, making these clutches prone to slip during vehicle operation. Slipping of the shifting clutches must be avoided, as these clutches will be destroyed by unwanted slipping.

Low Potency Friction Modifiers—Structure (I)

The starting components for forming the structure (I) compounds are isomerized alkenyl succinic anhydrides which are prepared from maleic anhydride and internal olefins i.e., olefins which are not terminally unsaturated and therefore do not contain the

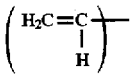

moiety. These internal olefins can be introduced into the reaction mixture as such, or they can be produced in situ by exposing alpha-olefins to isomerization catalysts at high temperatures. A process for producing such materials is described in U.S. Pat. No. 3,382,172. The isomerized alkenyl substituted succinic anhydrides have the structure shown as structure (II), where structure (II) is represented by:

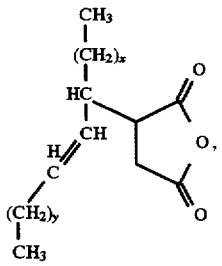

(II)

where x and y are independent integers whose sum is from 1 to 30.

The preferred succinic anhydrides are produced from isomerization of linear alpha-olefins with an acidic catalyst followed by reaction with maleic anhydride. The preferred alpha-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The isomerized alkenyl succinic anhydrides are then further reacted with polyamines of structure (III), where structure (III) is represented by:

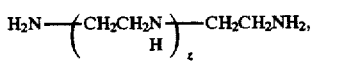

(III)

where z is an integer from 1 to 10, preferably from 1 to 3.

These are common polyethylene amines. When z=1 the material is diethylene triamine, when z=2 the material is triethylene tetramine, when z=3 the material is tetraethylene pentamine, for products where z>3 the products are commonly referred to as 'polyamine' or PAM. The preferred products of this invention employ diethylene triamine, triethylene tetramine, tetraethylene pentamine or mixtures thereof.

The isomerized alkenyl succinic anhydrides (II) are typically reacted with the amines in a 2:1 molar ratio so that both primary amines are converted to succinimides. Sometimes a slight excess of isomerized alkenyl succinic anhydride (II) is used to insure that all primary amines have reacted. The products of the reaction are shown as structure (I).

The di-succinimides of structure (I) may be further post-treated by any number of techniques known in the art. These techniques would include, but not be limited to: boration, maleation, acid treating with inorganic acids such as phosphoric, phosphorous, and sulfuric. Descriptions of these processes can be found in, for example, U.S. Pat. Nos. 3,254,025; 3,502,677; 4,686,054; and 4,857,214.

Another useful derivative of the low potency friction modifiers are where the isomerized alkenyl groups of structures (I) and (II) have been hydrogenated to form their saturated alkyl analogs. These saturated versions of structures (I) and (II) may likewise be post-treated as previously described.

While any effective amount of the compounds of structure (I) and its derivatives may be used to achieve the benefits of this invention, typically these effective amounts will range from 0.5 to 10, preferably from 2 to 7, most preferably from 3 to 6 weight percent of the finished fluid.

Examples for producing the structure (I) compounds of the present invention are given below. These examples are intended for illustration and the invention is not limited to the specific details set forth.

PREPARATIVE EXAMPLES

Example A

Into a one liter round bottomed flask fitted with a mechanical stirrer, nitrogen sweep, Dean Starke trap and condenser was placed 352 gm (1.00 mole) of iso-octadecenylsuccinic anhydride (ODSA from Dixie Chemical Co.). A slow nitrogen sweep was begun, the stirrer started and the material heated to 130° C. Immediately, 87 gm (0.46 moles) of commercial tetraethylene pentamine was added slowly through a dip tube to the hot stirred iso-octadecenylsuccinic anhydride. The temperature of the mixture increased to 150° C. where it was held for two hours. During this heating period 8 ml. of water (~50% of theoretical yield) were collected in the Dean Starke trap. The flask was cooled to yield the product. Yield: 427 gm. Percent nitrogen: 7.2.

Example B

The procedure of Example A was repeated except that the following materials and amounts were used: iso-octadecenylsuccinic anhydride, 458 gm ( 1.3 moles), and; diethylenetriamine, 61.5 gm (0.6 m). The water recovered was 11 ml. Yield: 505 gm. Percent nitrogen: 4.97.

Example C

The procedure of Example A was repeated except that the following materials and amounts were used: iso-hexadecenylsuccinic anhydride (ASA-100 from Dixie Chemical Co.), 324 gm (1.0 mole), and; tetraethylenepentamine, 87 gm, 0.46 mole). The water recovered was 9 ml. Yield: 398 gm. Percent nitrogen: 8.1.

Example D

The product of Example A, 925 gm (1.0 mole), and 300 gm of a naphthenic base oil (EXXON Necton 37) were placed in a 2 liter flask fitted with a heating mantle, an overhead stirrer, nitrogen sweep and condenser. The temperature of the mixture was raised to 80° C., the stirrer started and a nitrogen sweep begun. To this hot solution maleic anhydride, 98 gm (1.0 mole), was added slowly over about 20 minutes. Once the addition was complete the temperature was raised to 150° C. and held for 3 hours. The product was cooled and filtered. Yield: 1315 gm. Percent nitrogen: 5.2%.

Example E

The product of Example A, 925 gm (1.0 mole), and 140 gm of a naphthenic base oil (EXXON Necton 37) and 1 gm of DC-200 anti-foamant were placed in a 2 liter round bottomed flask fitted with a heating mantle, an overhead stirrer, nitrogen sweep, Dean Starke trap and condenser. The solution was heated to 80° C. and 62 gm (1.0 mole) of boric acid was added. The mixture was heated to 140° C. and held for 3 hours. During this heating period 3 ml. of water were collected in the Dean Starke trap. The product was cooled and filtered. Yield: 1120 gm. Percent nitrogen: 6.1; percent boron: 0.9

Oil-Soluble Phosphorus-Containing Compounds

The oil-soluble phosphorus-containing materials useful in this invention are the alkyl phosphites, ashless dispersants post-treated with phosphorus acids and optionally boron, and zinc salts of thiophosphoric acids.

The phosphites useful in this invention are di- and tri-alkyl phosphites shown as structures (IV) and (V) respectively, and phosphates shown as structure (VI), where these structures are represented by:

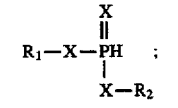

(IV)

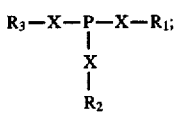

(V)

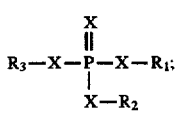

(VI)

where

X is independently O or S, i.e., in any given phosphite some X's may be O, while others are S. The R groups are $C_4$ to $C_{20}$ hydrocarbyl. R can also vary independently, they can be alkyl or aryl, they may be substituted by hetero atoms such as S, N, or O. The alkyl groups may be linear or branched, the aryl groups may be phenyl or substituted phenyl. The R groups may also be saturated or unsaturated. The preferred phosphites are the trialkyl phosphites (V). The preferred materials have at least one X=S, more preferred is all X's=S. The R groups are preferably linear alkyl groups, such as octyl, decyl, dodecyl, tetradecyl and octadecyl. Most preferred are dodecyl and tetradecyl.

Another type of phosphorus-containing compound useful in this invention are the mixed thio-alkyl phosphites described in U.S. Pat. No. 5,185,090.

The phosphorus-containing dispersants useful with the present invention are produced by post treating ashless dispersants with acids or anhydrides of phosphorus, and optionally boron. The ashless dispersants can be selected from hydrocarbyl succinimides, hydrocarbyl succinamides, mixed ester amides of hydrocarbyl substituted succinic acid, hydroxyesters of hydrocarbyl substituted succinic acids, Mannich condensation products of hydrocarbyl substituted phenols, formaldehyde and polyamines. Mixtures of dispersants can also be used. The preferred ashless dispersant are the polyisobutylene succinimides of polyamines such as tetraethylene pentamine. The polyisobutylene moieties preferably have molecular weights from approximately 300 to 3000. The ashless dispersants are further post treated with sources of phosphorus and optionally boron. Suitable inorganic phosphorus acids and anhydrides which are useful in forming these products include phosphorous acid, phosphoric acid, hypophosphoric acid, phosphorus trioxide, phosphorus tetraoxide, phosphoric anhydride. Partial and total sulfur analogs of the inorganic acids and anhydrides are also suitable such as phosphorotetrathioc acid, phosphoromonothioc acid, phosphorodithioc acid and phosphorotrithioc acid. The preferred phosphorus source is phosphorous acid. The preparation of these materials and their boronated analogs is well known, see, e.g., U.S. Pat. Nos. 3,502,677 and 4,857,214.

Another type of phosphorus-containing compound useful with this invention are the zinc dithiodiphosphates (ZDDP). These compounds are produced by reaction of alcohols with $P_2S_5$ to produce dialkylthiophosphoric acids, which are then treated/reacted with zinc oxide. The preparation of zinc dithiodiphosphate is well known and discussed in much published literature. See for example the books, "Lubricant Additives," by C. V. Smalheer and R. K. Smith, published by Lezius-Hiles Co., Cleveland, Ohio (1967) and "Lubricant Additives," by M. W. Ranney, published by Noyes Data Corp., Park Ridge, N.J. (1973). Examples of such materials are zinc (di-isooctyldithiophosphoric acid) and zinc (di-2-ethylhexyldithiophosphoric acid).

While any effective amount of the phosphorus-containing compounds may be used to achieve the benefits of this invention, typically these effective amounts will contribute to the finished fluid from 10 to 1000, preferably from 100 to 750, most preferably from 200 to 500 ppm of phosphorus.

In order to produce a homogeneous product, it may be desirable to pre-mix or pre-contact at elevated temperatures the low potency friction modifiers with the oil-soluble ashless phosphorus-containing compounds. Optionally, other additives which do not interfere with producing the homogeneous product are included. Typical elevated temperatures range from 30 to 150, preferably from 45 to 125, most preferably from 55° to 75° C.

Metallic Detergents

The metal-containing detergents of the compositions of this invention are exemplified by oil-soluble neutral or overbased salts of alkali or alkaline earth metals with one or more of the following acidic substances (or mixtures thereof: (1) sulfonic acids, (2) carboxylic acids, (3) salicylic acids, (4) alkyl phenols, (5) sulfurized alkyl phenols, (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° to 200° C.

Examples of suitable metal-containing detergents include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been called, simply, neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred metallic detergents for use with this invention are overbased sulfurized calcium phenates, overbased calcium sulfonates, and overbased magnesium sulfonates.

While any effective amount of the metallic detergents may be used to enhance the benefits of this invention, typically these effective amounts will range from 0.01 to 2.0, preferably from 0.05 to 1.0, most preferably from 0.05 to 0.5 weight percent in the finished fluid.

Polyol Ester Friction Modifiers

The optional polyolester friction modifiers of this invention are the esters of polyalcohols with long chain fatty acids. These materials have the structures shown as (VII), (VIII), and (IX) where (VII), (VII), and (IX) are represented by:

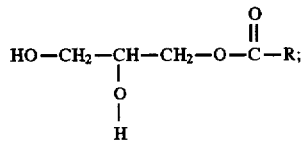

(VII)

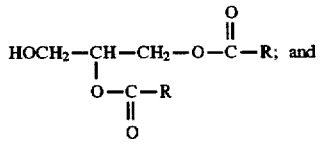

(VIII)

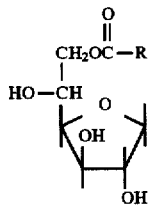

(IX)

where

R is aliphatic hydrocarbyl, including straight chain, saturated or unsaturated hydrocarbyl group, typically aliphatic having from about 9 to about 29, preferably from about 11 to about 23 and most preferably from about 15 to about 20 carbon atoms. The term 'hydrocarbyl' is used herein to include substantially hydrocarbyl groups, as well as purely hydrocarbyl groups. The description of these groups as being substantially hydrocarbyl means that they contain no non-hydrocarbyl substituents or non-carbon atoms which significantly affect the hydrocarbyl properties relative to the description herein.

Representative examples of suitable fatty acids include nonanoic (pelargonic); decanoic (capric); undecanoic; dodecanoic (lauric); tridecanoic; tetradecanoic (myristic); pentadecanoic; hexadecanoic (palmytic); heptadecanoic (margaric); octadecanoic (stearic or iso-stearic); nonadecanoic; eicosic(arachidic); decenoic; undecenoic; dodecenoic; tridecenoic; pentadecenoic; hexadecenoic; heptadecenoic; octadecenoic (oleic); eicosenoic or mixtures thereof.

Examples of suitable polyol esters useful in this invention are: glycerol mono-oleate, glycerol dioleate, glycerol mono-isostearate, tri-glycerol di-isostearate, sorbitan mono-oleate, sorbitan sesquioleate, sorbitan trioleate, sorbitan stearate, sorbitan palmitate. The preferred polyol ester type friction modifiers for use in this invention are glycerol mono-oleate and glycerol dioleate, and mixtures thereof.

While any effective amount of the polyol ester friction modifiers may be used to enhance the benefits of this invention, typically these effective amounts with range from 0.01 to 10.0, preferably from 0.1 to 5.0, most preferably from 0.1 to 3.0 weight percent in the finished fluid.

Other additives known in the art may be added to the power transmitting fluids of this invention. These additives include dispersants, antiwear agents, corrosion inhibitors, detergents, extreme pressure additives, and the like. They are typically disclosed in, for example, "Lubricant Additives" by C. V. Smalheer and R. Kennedy Smith, 1967, pp. 1–11 and U.S. Pat. No. 4,105,571.

Representative amounts of these additives in an ATF are summarized as follows:

| Additive | (Broad) Wt. % | (Preferred) Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677 and 4,857,214).

The additive combinations of this invention may be combined with other desired lubricating oil additives to form a concentrate. Typically the active ingredient (a.i.) level of the concentrate will range from 20 to 90, preferably from 25 to 80, most preferably from 35 to 75 weight percent of the concentrate. The balance of the concentrate is a diluent typically comprised of a lubricating oil or solvent.

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly(1-decenes), etc., and mixtures thereof]; alkylbenzenes [e.g., dodecylbenzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethylhexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl)silicate, tetra-(4-methyl-2-ethylhexyl) silicate, tetra-(p-tert-butylphenyl)silicate, hexa-(4-methyl-2-pentoxy)-disiloxane, poly(methyl)-siloxanes and poly (methylphenyl)siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

The following examples are given as specific illustrations of the claimed invention. It should be understood, however, that the invention is not limited to the specific details set forth in the examples. All parts and percentages are by weight unless otherwise specified.

Examples

No standardized test exists for evaluating anti-shudder durability of automatic transmission fluids. Several test methods have been discussed in published literature. The methods all share a common theme, that is, continuously sliding a friction disk, immersed in a test fluid, at a certain set of conditions. At preset intervals the friction versus velocity characteristics of the fluid are determined. The common failing criteria for these tests is when dMu/dV (the change in friction coefficient with velocity) becomes negative, i.e., when increasing velocity results in lower friction coefficient. A similar method which is described below, has been used to evaluate the compositions of this invention.

Anti-Shudder Durability Test Method

An SAE No. 2 test machine fitted with a standard test head was modified to allow test fluid to be circulated from an external constant temperature reservoir to the test head and back. The test head is prepared by inserting a friction disk and two steel separator plates representative of the sliding torque converter clutch (this assembly is referred to as the clutch pack). Two liters of test fluid are placed in the heated bath along with a 32 $cm^2$ (5 $in.^2$) copper coupon. A small pump circulates the test fluid from the reservoir to the test head in a loop. The fluid in the reservoir is heated to 145° C. while being circulated through the test head, and 50 ml./min. of air are supplied to the test head. The SAE No. 2 machine drive system is started and the test plate rotated at 180 rpm, with no apply pressure on the clutch pack. This break-in period is continued for one hour. At the end of one hour five (5) friction coefficient (Mu) versus velocity measurements are made. Then 6 dynamic engagements of 13,500 joules each are run, followed by one measurement of static breakaway friction. Once this data collection is accomplished a durability cycle is begun.

The durability cycle is run in approximately one hour segments. Each hour the system is "slipped" at 1550° C., 180 rpm, and 10 $kg/cm^2$ for 50 minutes. At the end of the 50 minutes of slipping, twenty (20) 13,500 joule dynamic engagements are run. This procedure is repeated three more times, giving a four hour durability cycle. At the end of four hours, 5 Mu versus velocity measurements are made at 1200° C. The dMu/dV for the fluid is calculated by averaging the 3rd, 4th, and 5th Mu versus velocity measurements and calculating dMu/dV by subtracting the Mu value at 0.35 m/s from the Mu value at 1.2 m/s and dividing by the speed difference, 0.85 m/s. For convenience the number is multiplied by 1000 to convert it to a whole number. A fluid is considered to have lost anti-shudder protection when the dMu/dV reaches a value of negative three (−3). The result is reported as "Hours to Fail". Several commercial ATF's which do not possess anti-shudder durability characteristics have been evaluated by this test method. They give "Hours to Fail" in the range of 15 to 25.

Thus, for purposes of this invention, achieving an "Hours to Fail" of at least 30 hours is indicative of improved anti-shudder durability.

Example 1

Effect of the Low Potency Friction Modifier of Structure (I)

Nine (9) test fluids were prepared for anti-shudder durability evaluation by the foregoing procedure and are shown in Table 1 as Blends 1–9. Blends 1 through 6 containing the friction modifiers of structure (I), all give anti-shudder durability significantly higher than the failing time of 30 hours. Blend 1 gives greater than six times the anti-shudder durability of the base 30 hour failure time. Blends 1, 7, 8 and 9 show the effect of friction modifier concentration. At a concentration of 1.5 mass percent the product of Example A gives an anti-shudder durability value approaching the 30 hour failure value, however, it is still about 1.5 times better than a failing anti-shudder fluid. Increasing the concentration of the product of Example A results in significantly better anti-shudder durability, i.e., compare Blends 1 and 9.

Example 2

Effect of Phosphorus Source

Eight (8) blends were prepared for anti-shudder durability evaluation by the same foregoing procedure and are shown as Blends 10 to 17 in Table 2. Blends 10 through 16 contain various ashless phosphorus sources. Blend 10 uses di-butyl hydrogen phosphite (structure IV, $R_1=R_2=C_4H_9$, X=O). Blend 11 uses di-lauryl hydrogen phosphite (structure IV, $R_1=R_2=C_{12}H_{25}$, X=O). Blend 12 uses tri-lauryl phosphite (structure V, $R_1=R_2=R_3=C_{12}H_{25}$, X=O). Blend 13 uses triphenyl phosphite (structure V, $R_1=R_2=R_3=C_6H_5$, X=O). Blend 14 uses a complex phosphite prepared as described in U.S. Pat. No. 5,185,090, Example 13. Blend 15 uses trilauryltrithiophosphite (structure V, $R_1=R_2=R_3=C_{12}H_{25}$, X=S). Blend 16 uses a 450 MW polyisobutenyl succinic anhydride-polyamine (PIBSA-PAM) which has been treated with phosphorous acid ($H_3PO_3$). Blend 17 again uses trilauryltrithiophosphite at a higher concentration. Blends 10 through 17 contain approximately 300 ppm of phosphorus.

The test results in Table 2 show that all of the above ashless phosphorus sources provide excellent anti-shudder durability, at least four (4) times better than the failing value of 30 hours.

Example 3

Effect of Metallic Detergent

Six (6) blends were prepared for anti-shudder evaluation by the foregoing procedure and are shown as Blends 18–23 in Table 3. The six blends use varying types and concentrations of metallic detergents. The results in Table 3 show that when compared to blends without metallic detergent (Blend 18) those blends containing metallic detergents (Blends 19 through 23) performed significantly better. All six blends gave anti-shudder durability significantly better than the 30 hour failure mark, and blends with high levels of metallic detergents, e.g., Blend 21, gave exceptionally strong anti-shudder durability of 192 hours.

The principles, preferred embodiments , and modes of operation of the present invention have been described in the foregoing specification. The invention which is intended to be protected herein, however, is not to be construed as limited to the particular forms disclosed, since these are to be regarded as illustrative rather than instructive. Variations and changes may be made by those skilled in the art without departing from the spirit of the invention.

TABLE 1

Effect of Friction Modifier

| BLENDS: | 1 | 2 | 3 | 4 | 5 | 6 | 7 | 8 | 9 |
|---|---|---|---|---|---|---|---|---|---|
| Component | | | | | | | | | |
| Borated PIBSA/PAM Dispersant | 3.50 | 3.50 | 3.50 | 3.50 | 3.25 | 3.50 | 3.50 | 3.50 | 3.50 |
| Diphenylamine anti-oxidant | 0.30 | 0.30 | 0.30 | 0.30 | 0.30 | 0.30 | 0.30 | 0.30 | 0.30 |
| HIndered phenol anti-oxidant | 0.50 | 0.50 | 0.50 | 0.50 | 0.50 | 0.50 | 0.50 | 0.50 | 0.50 |
| Tolyltriazole | 0.05 | 0.05 | 0.05 | 0.05 | 0.05 | 0.05 | 0.05 | 0.05 | 0.05 |
| 300 TBN Ca Sulfonate | 0.10 | 0.10 | 0.10 | 0.10 | 0.10 | 0.10 | 0.10 | 0.05 | 0.30 |
| TrilauryllTrithiophosphite | 0.62 | 0.62 | 0.62 | 0.62 | 0.62 | 0.62 | 0.62 | 0.62 | 0.51 |
| Product of Example A | 3.00 | — | — | — | — | — | 2.50 | 2.00 | 1.50 |
| Product of Example B | — | — | — | — | 3.10 | 2.0 | — | — | — |
| Product of Example C | — | 2.00 | — | — | — | — | — | — | — |
| Product of Example D | — | — | 3.10 | — | — | — | — | — | — |
| Product of Example E | — | — | — | 2.5 | — | — | — | — | — |
| Glycerol Mono-oleate | — | — | — | — | 0.25 | — | — | — | — |
| Sorbitan Stearate | — | — | — | — | — | 0.25 | — | — | — |
| Results | | | | | | | | | |
| Hours to Fail | 192 | 96 | 148 | 72 | 92 | 68 | 148 | 104 | 44 |

TABLE 2

Effect of Phosphorus Source

| BLENDS: | 10 | 11 | 12 | 13 | 14 | 15 | 16 | 17 |
|---|---|---|---|---|---|---|---|---|
| Component | | | | | | | | |
| Borated PIBSA/PAM Dispersant | 3.50 | 3.50 | 3.50 | 3.50 | 3.25 | 3.50 | 3.50 | 3.50 |
| Diphenylamine anti-oxidant | 0.30 | 0.30 | 0.30 | 0.30 | 0.30 | 0.30 | 0.30 | 0.30 |
| HIndered phenol anti-oxidant | 0.50 | 0.50 | 0.50 | 0.50 | 0.50 | 0.50 | 0.50 | 0.50 |
| Tolyltriazole | 0.05 | 0.05 | 0.05 | 0.05 | 0.05 | 0.05 | 0.05 | 0.05 |
| 300 TBN Ca Sulfonate | 0.10 | 0.10 | 0.10 | 0.10 | 0.10 | 0.10 | 0.10 | 0.10 |

TABLE 2-continued

| Effect of Phosphorus Source | | | | | | | | |
|---|---|---|---|---|---|---|---|---|
| BLENDS: | 10 | 11 | 12 | 13 | 14 | 15 | 16 | 17 |
| Product of Example A | 2.50 | 2.50 | 2.50 | 2.50 | 2.50 | 2.50 | 2.50 | 2.50 |
| Dibutyl hydrogen phosphite | 0.19 | — | — | | | | | |
| Dilauryl hydrogen phosphite | — | 0.41 | — | | | | | |
| Trilauryl hydrogen phosphite | — | — | 0.57 | — | — | — | — | — |
| Triphenyl phosphite | — | — | — | 0.30 | — | — | — | — |
| Mixed alkyl mono & di-phosphite | — | — | — | — | 0.58 | — | — | — |
| TrilaurylTrithiophosphite | — | — | — | — | — | 0.62 | — | 0.82 |
| 450 MW PIBSA/PAM post treated with H3PO3 | — | — | — | — | — | — | 1.17 | — |
| Results | | | | | | | | |
| Hours to Fail | 144 | 160 | 128 | 148 | 136 | 148 | 120 | 148 |

TABLE 3

| Effect of Metallic Detergent | | | | | | |
|---|---|---|---|---|---|---|
| BLENDS: | 18 | 19 | 20 | 21 | 22 | 23 |
| Component | | | | | | |
| Borated PIBSA/PAM Dispersant | 3.50 | 3.50 | 3.50 | 3.50 | 3.25 | 3.50 |
| Diphenylamine anti-oxidant | 0.30 | 0.30 | 0.30 | 0.30 | 0.30 | 0.30 |
| Hindered phenol anti-oxidant | 0.50 | 0.50 | 0.50 | 0.50 | 0.50 | 0.50 |
| Tolyltriazole | 0.05 | 0.05 | 0.05 | 0.05 | 0.05 | 0.05 |
| Trilauryl trithiophosphite | 0.62 | 0.62 | 0.62 | 0.62 | 0.62 | 0.62 |
| Product of Example A | 2.50 | 2.50 | 3.00 | 3.00 | 2.50 | 2.50 |
| 20 TBN Ca Sulfonate | — | 0.10 | — | — | — | — |
| 300 TBN Ca Sulfonate | — | — | 0.05 | 0.1 | — | — |
| 400 TBN Mg Sulfonate | — | — | — | — | 0.05 | — |
| 260 TBN Ca Phenate | — | — | — | — | — | 0.10 |
| Results | | | | | | |
| Hours to Fail | 44 | 152 | 176 | 192 | 124 | 116 |

What is claimed is:

1. A power transmitting fluid comprising:

(1) a major amount of a lubricating oil, and (2) an anti-shudder improving effective amount of an additive combination comprising:

(a) a reaction product of an isomerized alkenyl substituted succinic anhydride and a polyamine characterized by structure (I), where structure (I) is:

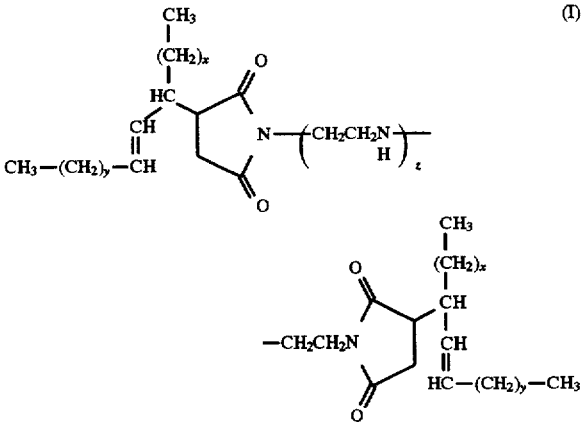

(I)

where x and y are independent integers whose sum is from 1 to 30, and z is an integer from 1 to 10;

(b) an oil-soluble phosphorus-containing compound; and (c) optionally, an additive selected from the group consisting of a metallic detergent, a polyol ester friction modifier, and mixtures thereof.

2. The composition of claim 1, where the lubricating oil is a mineral oil, poly-α-olefin, or mixtures thereof.

3. The composition of claim 2, where the phosphorus-containing compound is selected from the group consisting of a phosphite, thiophosphite, phosphate, thiophosphate, zinc dithiodiphosphate, amine phosphate, amine-containing compounds treated with inorganic phosphorus or their thio analogs or boron, and mixtures thereof.

4. The composition of claim 3, where the sum of x+y is 13 or 15.

5. The composition of claim 4, where the metallic detergent is overbased calcium sulfonate.

6. The composition of claim 5, where the polyol ester is a mixture of glycerol mono- and di-oleates.

7. The composition of claim 4, where the fluid is an automatic transmission fluid.

8. An additive concentrate comprising a major amount of the additive combination of claim 1 with other desired lubricating oil additives and a minor amount of lubricating oil.

9. A method of improving the anti-shudder durability of a power transmitting fluid by incorporating into the fluid an anti-shudder durability improving effective amount of the additive concentrate of claim 8.

10. A process of producing the composition according to claim 1, wherein the additive combination of 2(a) and 2(b) has been pre-mixed at temperatures sufficient to produce a homogeneous composition.

11. The composition of claim 1, wherein the isomerized alkenyl group is hydrogenated to its saturated alkyl analog.

12. The composition of claim 1, wherein the reaction product has been post-treated by boration, maleation, or acid treatment with an inorganic acid selected from the group consisting of phosphoric acid, phosphorous acid, and sulfuric acid.

13. The composition of claim 11, wherein the reaction product has been post-treated by boration, maleation, or acid treatment with an inorganic acid selected from the group consisting of phosphoric acid, phosphorous acid, and sulfuric acid.

* * * * *